United States Patent [19]

Buford et al.

[11] Patent Number: 4,944,405

[45] Date of Patent: Jul. 31, 1990

[54] MULTI-CELLED ENCLOSED CARTON

[75] Inventors: John C. Buford, Madison, Wis.; Leslie H. Porter, Chebanse, Ill.

[73] Assignee: Manville Corporation, Denver, Colo.

[21] Appl. No.: 415,161

[22] Filed: Sep. 29, 1989

[51] Int. Cl.[5] ..... B65D 5/48

[52] U.S. Cl. ..... 206/614; 206/611; 229/120.04; 229/120.17; 229/160

[58] Field of Search ..... 206/611, 614, 620; 229/120.04, 120.17, 127, 160

[56] References Cited

U.S. PATENT DOCUMENTS

| | | | |
|---|---|---|---|
| 1,928,660 | 10/1933 | Boeye | 229/120.04 |
| 2,450,941 | 10/1948 | Crane | 229/120.17 |
| 2,693,309 | 11/1954 | Giroux et al. | 229/120.17 |
| 2,698,708 | 1/1955 | Margolies | 229/120.17 |
| 3,145,902 | 8/1964 | Nolen | 229/120.17 |
| 3,270,947 | 9/1966 | Rasmussen | 229/127 |
| 3,370,776 | 2/1968 | Krzyzonowski | 206/620 |
| 4,396,145 | 8/1983 | Ditton | 229/120.17 |

*Primary Examiner*—Gary E. Elkins

*Attorney, Agent, or Firm*—John D. Lister

[57] ABSTRACT

A fully enclosed carton divided into four cells. Cell-dividing flaps connected to the bottom panel flaps extend into the interior of the carton through the spaces separating adjacent dust flaps. A cell-dividing flap connected to the top panel flap extends into the interior through spaces separating adjacent bottom panel cell-dividing flaps. The carton is formed from an integral blank, and the contents can be reached through tear strips in the top panel or through openings in the side panels.

7 Claims, 4 Drawing Sheets

MULTI-CELLED ENCLOSED CARTON

FIELD OF THE INVENTION

This invention relates generally to enclosed cartons for packaging various kinds of articles. More particularly, it relates to a carton of this type which includes internal dividers for separating the interior into cells.

BACKGROUND OF THE INVENTION

It is well known to package articles in cartons which include dividers or separators for segregating the articles from each other. Many cartons of this type, however, require a separate operation to insert the dividers, which adds to the cost of the carton. Also adding to the cost is the greater amount of paperboard needed to fabricate such a carton.

In addition to the costs associated with the above problems, the packaging requirements of certain articles cause other problems, the solution to which is also usually expensive. For instance, if it is desired to package different types of articles in the same carton and to keep each type completely separate from the others, the package dividers are required to extend substantially all the way from the bottom to the top of the carton, which complicates the carton design considerably. An example of such a requirement would be a carton for packaging different types of food, such as different flavors of food packets or envelopes, where each different type of envelope has to be kept in its own separate compartment. Adding to the complicated design of such a package is the need to provide ready access to each of the cells in the carton so that the food packets can be easily dispensed from the carton as needed.

It would obviously be desirable to be able to package articles in segregated compartments of a carton without encountering excessive costs due to increased material usage or time consuming carton fabrication requirements.

BRIEF SUMMARY OF THE INVENTION

This invention overcomes the problems of the prior art by providing a multi-celled carton comprising four side panels connected to each other along fold lines, a bottom panel comprised of flaps connected along fold lines to the lower edges of each of two opposite side panels, and cell-dividing flap means connected along a fold line to the edge of at least one of the bottom flaps opposite the fold line connecting the bottom flap to its side panel. The flap means extends into the interior of the carton to divide it into two cells. Preferably, additional cell-dividing flap means are similarly connected to the other bottom flap, and the flap means are arranged face-to-face in the interior of the carton. Also, the flap means extend through the space between a plurality of dust flaps which are connected to the bottom edges of the other two side panels, which allows the freedom of movement necessary to position the flaps in the interior of the carton.

The carton may also include cell-dividing flap means connected along a fold line to an edge of at least one of the flaps forming the top panel of the carton. At least one of the top and bottom cell-dividing flap means includes a slot, with the other flap means fitting into the slot to thereby divide the interior of the carton into four cells.

The cell-dividing flaps are thus an integral part of the carton-forming blank and are set into place upon fabrication of the carton. Tear strips may be provided in the top panel to permit access to the interior of the carton in order to remove one or more articles, or dispenser openings may be provided in the side panels leading to each of the cells to allow articles to be removed one at a time.

Other features and aspects of the invention, as well as other benefits thereof, will readily be ascertained from the more detailed description of the preferred embodiment which follows.

DETAILED DESCRIPTION OF THE PREFERRED EMBODIMENT

Figure 1:
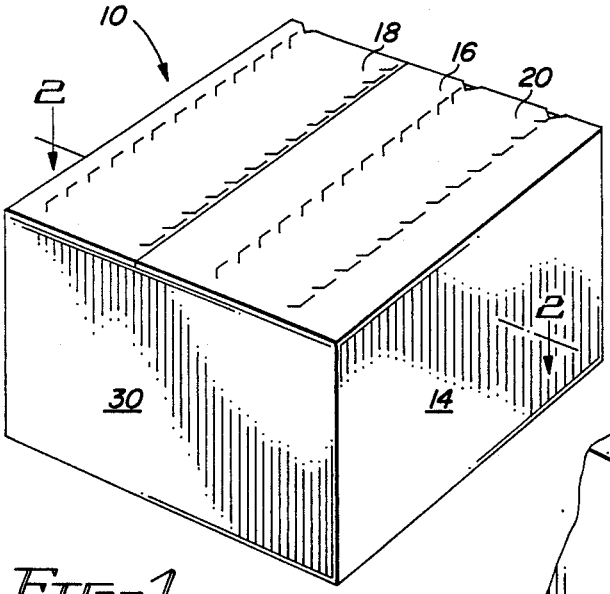
FIG. 1 is a pictorial view of an enclosed carton formed in accordance with the invention.
Figure 2:
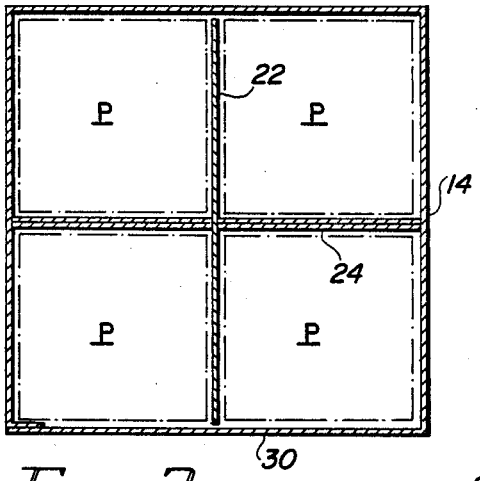
FIG. 2 is a transverse sectional view taken along line 2—2 of FIG. 1.

Referring to FIG. 1, the carton 10 of the invention comprises side panels 12 and 14, a bottom panel not visible in this view and a top panel 16. The top panel 16 contains tear strips 18 and 20 which when removed enable the interior of the carton to be reached. As shown in FIG. 2, the interior of the carton includes dividers 22 and 24 which divide the space into four cells. Each cell is designed to receive a stack of articles P, which typically may comprise packets or envelopes of food. The carton, including the cell dividers 22 and 24, is designed to be formed from a unitary blank.

Figure 3:
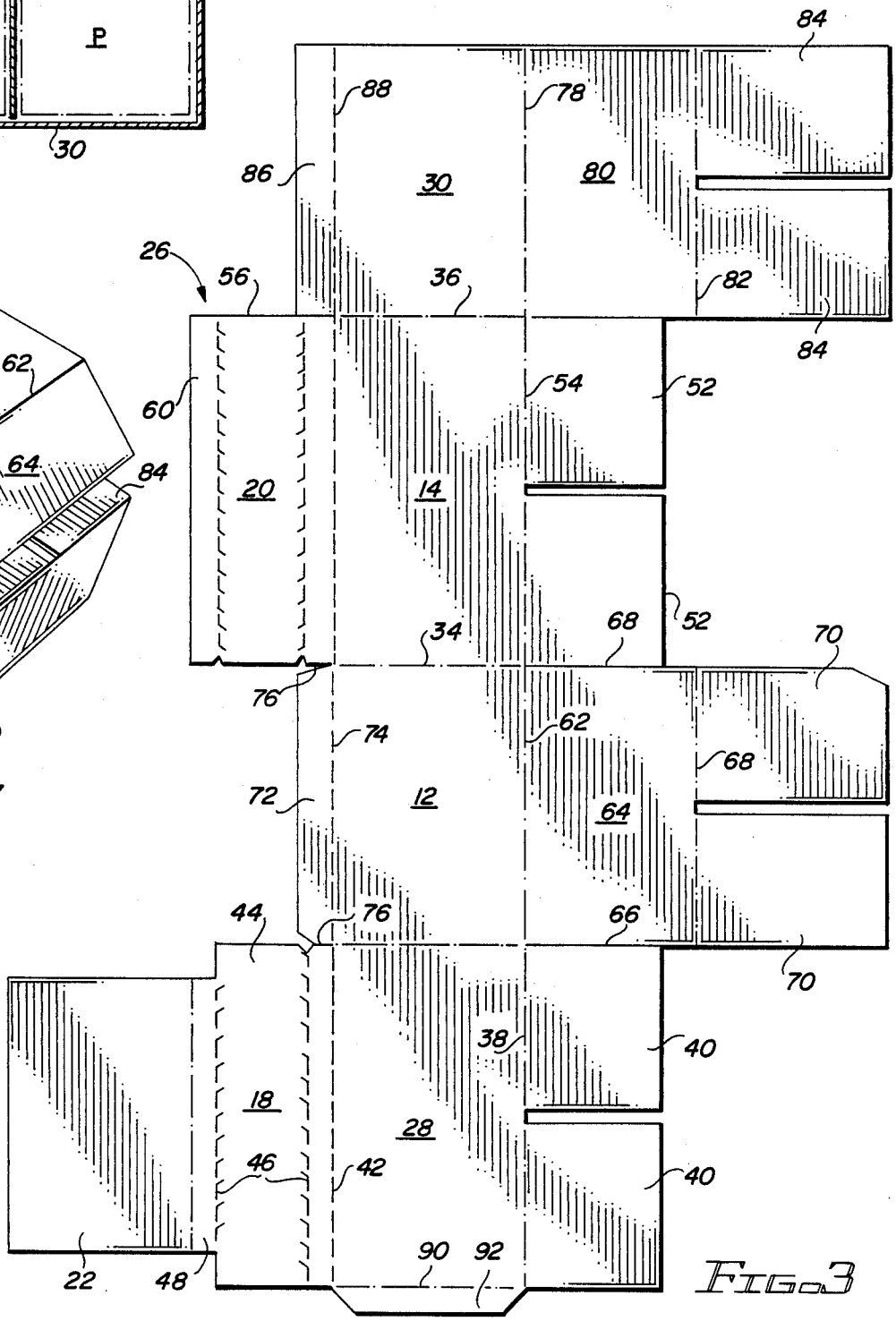
FIG. 3 is a plan view of a production blank used to form the carton of the invention.

Referring to FIG. 3, the unitary carton blank, indicated generally at 26, comprises rectangular side panel sections 28, 12, 14 and 30 connected along adjacent edges by score lines 32, 34 and 36, respectively. Connected to side panel section 28 along score line 38 are bottom panel dust flaps 40. The dust flaps are spaced from each other by a small amount, such as about ¼ inch, for a reason to be made clear hereinafter. Connected to the opposite edge of side panel section 28 along fold line 42 is a top panel flap 44 containing the tear strip 18. The tear strip 18 may be formed in any satisfactory manner, such as by spaced cuts 46 which extend generally parallel to the fold line 42. The length of the tear strip 18 and the portion of the top panel flap between the tear strip and the fold line 42 is equal to the length of the side panel section 28. The narrow portion 48 of the top panel flap 44 lying on the opposite side of the tear strip 18 is substantially shorter, for a reason to be explained hereinafter. Connected to the narrow portion 48 along score line 50 is the cell divider or separator flap 22, the length of which is the same as the length of the narrow portion 48.

The side panel section 14 corresponds in size to the side panel section 28, and is connected to bottom panel dust flaps 52 along score line 54 in the same manner as the dust flaps 40 are connected to the side panel section 28 along the score line 38. The dust flaps 52 are spaced from each other in the manner of dust flaps 40 and are of the same size as the dust flaps 40. A top panel flap 56 is connected to the side panel section 14 along fold line 58 and contains the tear strip 20. The top panel flap 56 is the same size as the top panel flap 44 except that the portion 60 extending beyond the tear strip 20 is not shorter, as in the top panel flap 5 44, but is of the same length as the rest of the flap.

Situated between the bottom dust flaps 40 and 52 and connected to the side panel section 12 along score line 62 is bottom panel flap 64. The bottom panel flap 64 is separated from the adjacent dust flaps 40 and 52 by common slits or cuts 66 and 68, respectively. Connected to the bottom panel flap 64 along score line 68 are divider flaps 70 which are spaced apart a short distance in the manner of dust flaps 40. The slits 66 and 68 and the outer edges of the divider flaps are aligned with score lines 32 and 34, respectively. In addition, a top dust flap 72 is connected to the side panel section 12 along fold line 74, and is separated by common slits 76 from the top panel flaps 44 and 56.

The side panel section 30 is arranged similarly to the side panel section 12, being connected along score line 78 to bottom panel flap 80, which in turn is connected along score line 82 to spaced divider flaps 84. Side panel section 30 is also connected to top dust flap 86 along fold line 88. The score lines 38, 62, 54 and 78 are all aligned with each other, as are the fold lines 42, 74, 58 and 88, thus allowing for the formation of a carton with panels arranged at right angles to each other.

Also connected to the blank along score line 90 is a glue flap 92. The score line 90 corresponds to the end edge of the side panel section 28 opposite the score line 32, so that the flap 92 corresponds in width to the width of the side panel sections.

Figure 4:
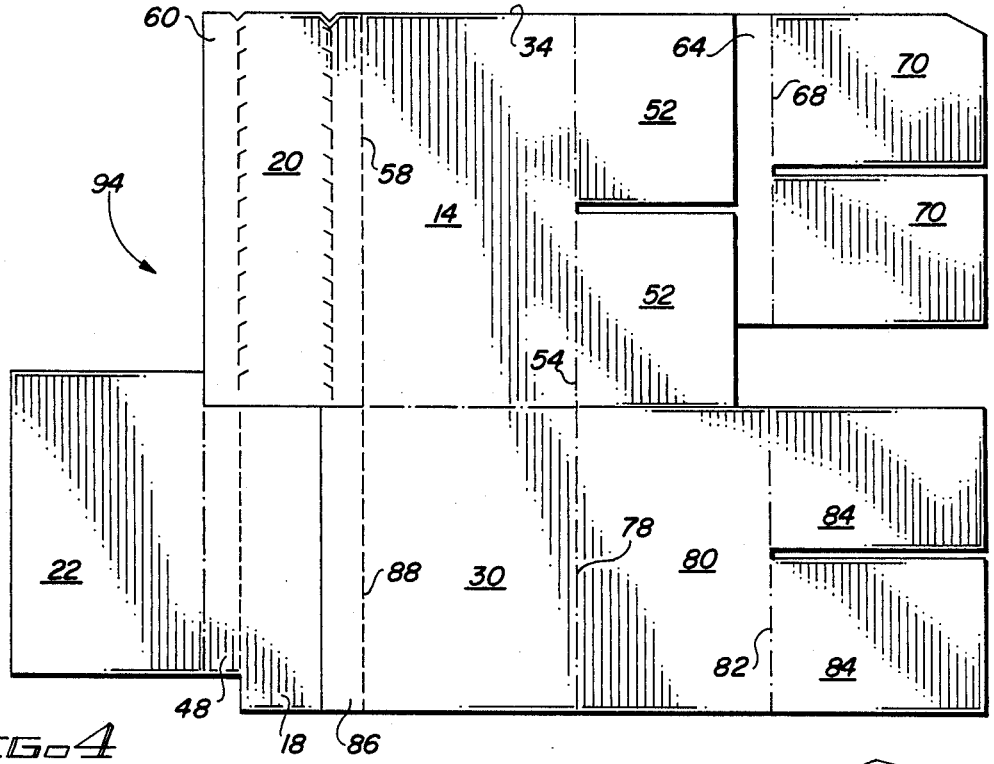
FIG. 4 is a view similar to that of FIG. 3, but showing the carton blank after it has been folded and glued into the intermediate form of a collapsed sleeve.

Referring now to FIGS. 3 and 4, to form a carton from the blank 26, assuming that the face of the blank shown in FIG. 3 is intended to be the interior surface of the carton, the portion of the blank extending up from the score line 34 is folded down about the score line 34 in face-to-face relationship with the portion of the blank below the score line. By previously folding the glue flap 92 up about its score line 90 and applying glue to the folded-up face of the glue flap, the free end portion of the side panel section 30 will contact the glue flap and adhere to it, resulting in the collapsed sleeve formation 94 of FIG. 4. It will be seen that the only portions of the original upwardly facing blank still visible are the divider flap 22, a portion of the tear strip 18 and connecting narrow portion 48, a portion of the bottom panel flap 64 and the divider flaps 70. The remaining visible surfaces portions which have been folded over and will become the outer surface of a carton formed from the blank. The blank is shipped in this collapsed sleeve configuration to the manufacturer of the articles to be packaged for formation of the final carton and loading of the articles into the carton.

Figure 6:
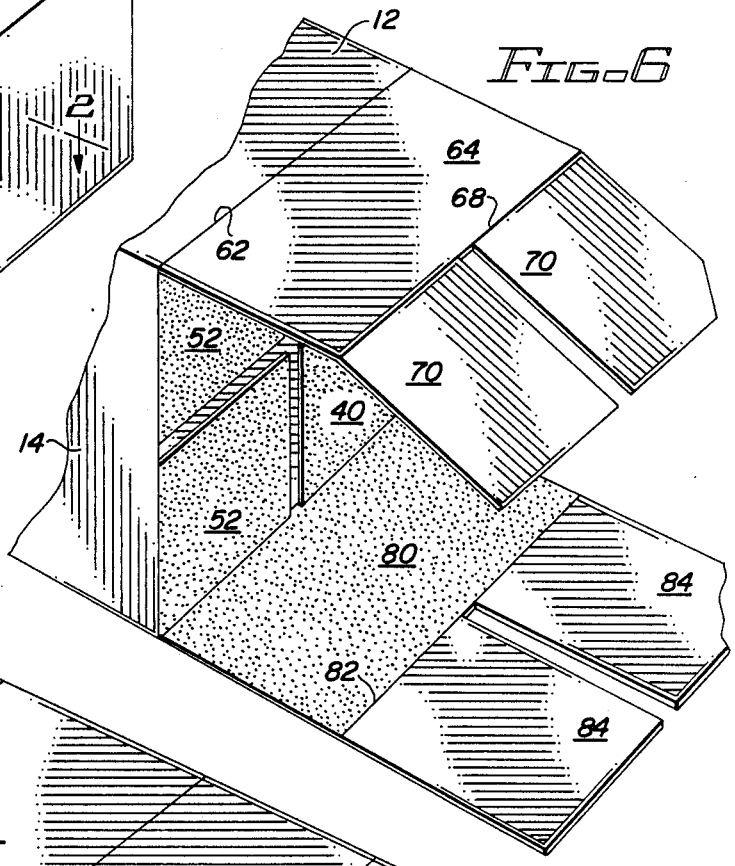
FIG. 6 is a partial pictorial view of the opened sleeve of FIG. 5, illustrating an intermediate bottom panel folding step.
Figure 5:
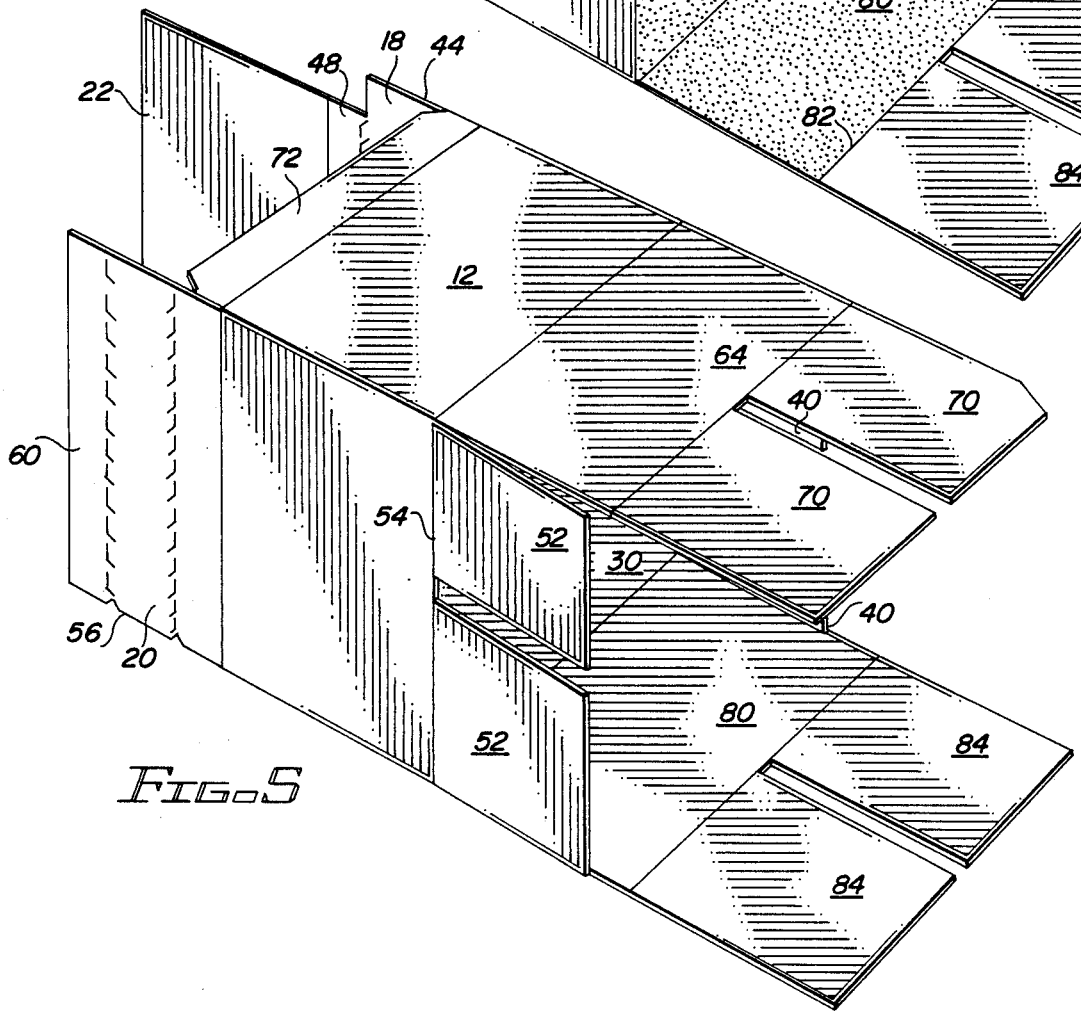
FIG. 5 is a pictorial view of the collapsed sleeve of FIG. 4 after it has been opened.
Figure 7:
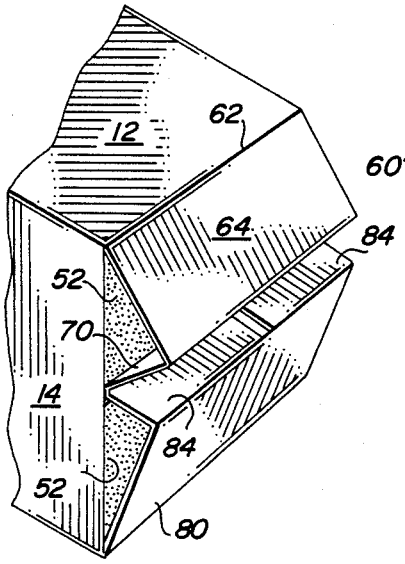
FIG. 7 is another partial pictorial view showing another folding; step in the formation of the bottom panel.
Figure 8:
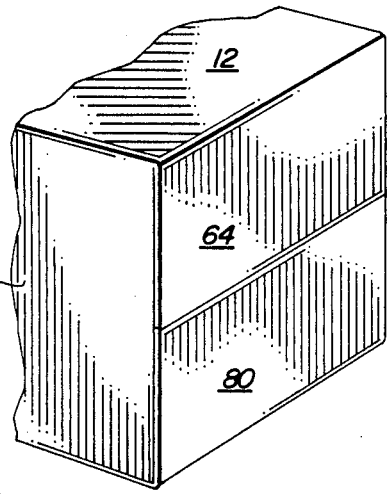
FIG. 8 is a partial pictorial view showing the closed bottom panel of the carton.

Referring to FIG. 5, the collapsed carton sleeve of FIG. 4 is opened to the condition shown by applying pressure to opposite corners of the collapsed sleeve. To form the bottom panel of the carton the bottom dust flaps 52 and 40 are folded inwardly about their score lines 54 and 38 through 90° to the position shown in FIG. 6. Adhesive, such as a suitable hot melt, is applied to the stippled surfaces of the dust flaps 52 and 40 and to the bottom panel flap 80, as well as to the underside of the bottom panel flap 64, not visible in this view. The bottom flaps 64 and 80 are then folded inwardly about their score lines 62 and 78 through an arc of 90°, and at the same time the divider flaps 70 and 84 are folded with respect to the bottom flaps 64 and 80 through an arc of 90° about their score lines 68 and 82. The carton end is shown in FIG. 7 in the final stages of these folding operations. Note that one of the cell divider flaps 70 and the corresponding cell divider flap 84 extend through the space between the dust flaps 52, while the other cell divider flaps 70 and 84 extend through the space between the dust flaps 40. As shown in FIG. 8, these steps result in the formation of the bottom panel of the carton comprised of the bottom panel flaps 64 and 80.

Figure 9:
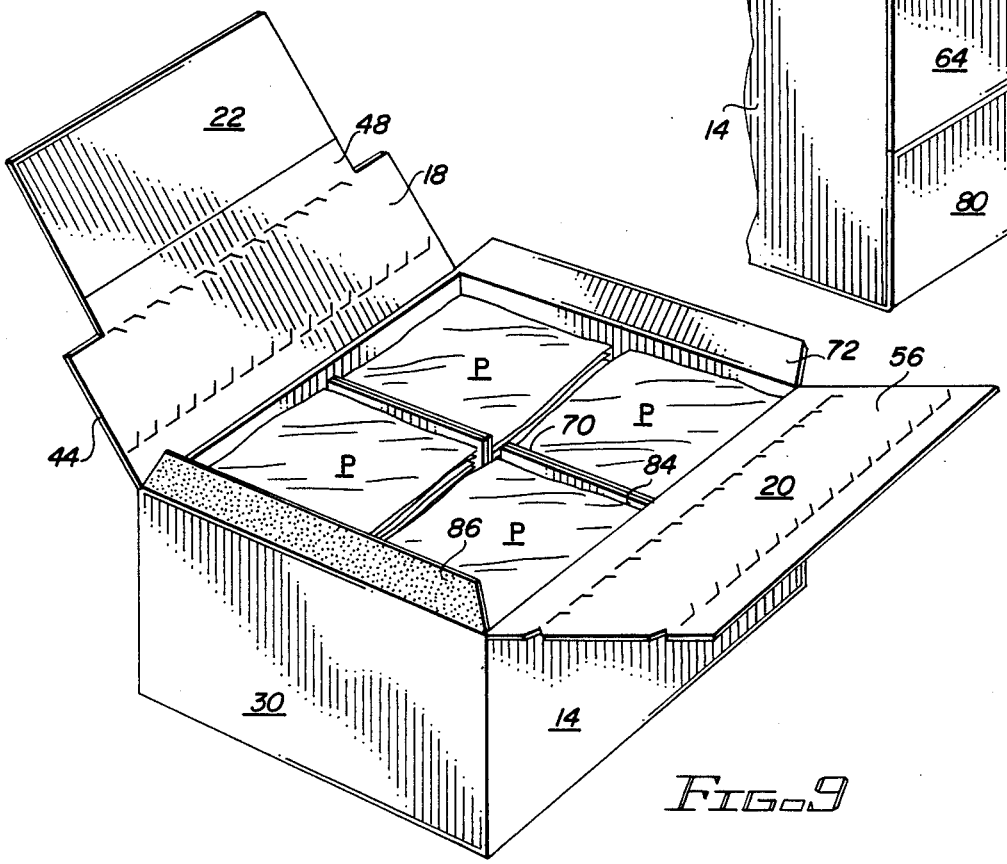
FIG. 9 is a pictorial view of the carton of the invention with the top panel in open condition ready to be loaded with articles to be packaged.

Referring now to FIG. 9, the carton at this stage of its assembly is shown resting on its bottom panel with the top panel flaps in open condition. The combined divider panels 84,70, which make up the divider 24 illustrated in FIG. 2, extend up from the bottom panel and divide the interior of the carton into two equal portions. The carton is now in condition to receive articles to be loaded.

Assuming that it is desired to package four segregated stacks of food packets, the packets P would be introduced with two stacks on one side of the divider flaps 84,70 and two on the other side. In order to show the location of the stacks of articles with respect to the cell divider flaps, they have been shown in phantom lines in FIGS. 9, 10 and 11.

Figure 10:
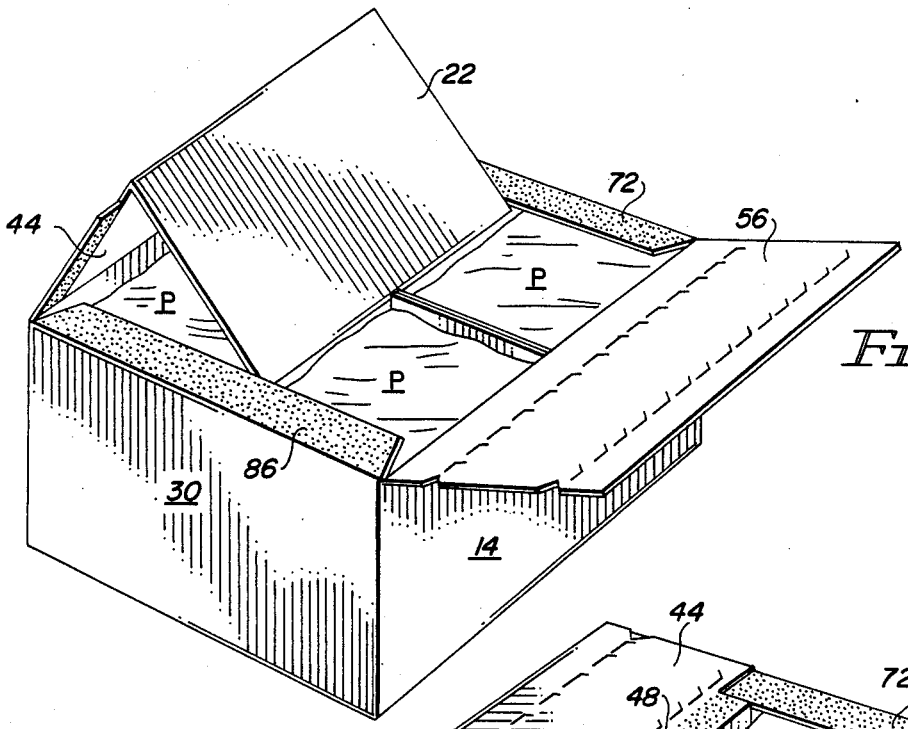
FIG. 10 is a pictorial view similar to that of FIG. 9, but showing the top panel in an intermediate stage of formation.
Figure 11:
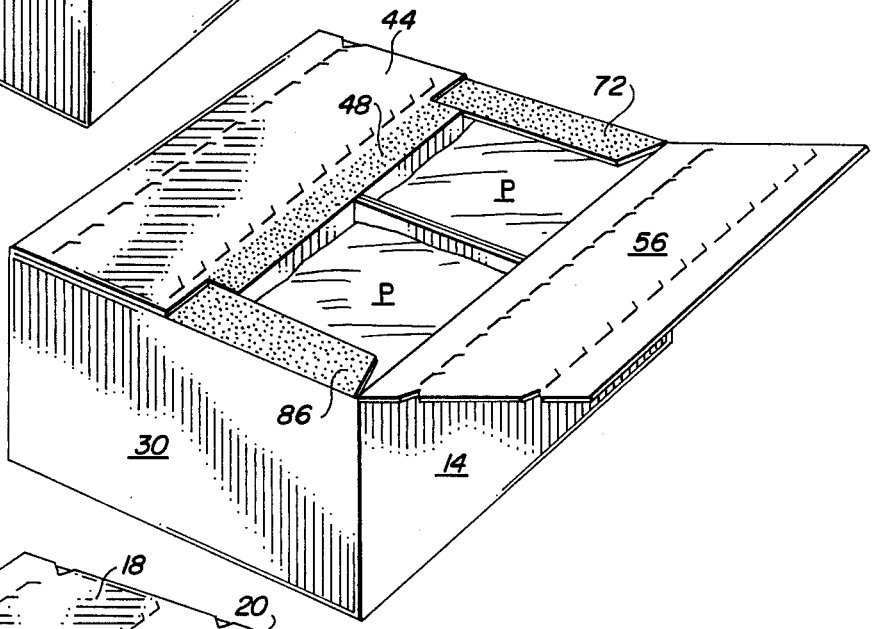
FIG. 11 is a pictorial view similar to that of FIG. 10, but showing the top panel in a further intermediate stage of formation.

As shown in FIG. 10, the next step in the forming operation is to fold in the top dust flaps 72 and 86, fold fold down the top panel flap 44 and fold down the top divider flap 22 through an arc of 90° with respect to the top panel flap 44. Prior to these folding steps the dust flaps 72 and 86 and the end portions of the top panel flap 44 which engage the dust flaps are coated with adhesive in the stippled areas. As illustrated, the divider flap 22 extends through the space between the bottom divider flaps 84,70 so as to divide the interior space of the carton into four cells of equal size. As shown in FIG. 11, upon completion of the described folding operations, the top panel flap 44 will be permanently adhered to the dust flaps 72 and 86 and the divider flap 22 will be firmly in place separating two of the stacks of articles from the other two. Adhesive is applied to the stippled areas of FIG. 11 and the top panel flap 56 is folded into place to be adhered to the dust flaps 72 and 86, thus forming the final loaded carton of FIG. 1.

It will be noted, particularly in FIG. 11, that the width of the top divider flap 22 and the width of the narrow portion 48 of the top panel flap 44 are such that these flaps are able to fit inside the dust flaps 72 and 86. This allows the divider flap to be folded down without interference from the dust flaps 72 and 86 and allows the narrow portion 48 to be positioned to be adhered to the overlapping edge portion of the top panel flap 56. It will be appreciated that the same relationship of elements can be achieved by maintaining the divider flap 22 and adjacent portion 48 at the full width of the top panel flap 44 and providing a notch or cutout in the dust flaps 72 and 86 to provide room for the divider flap 22 to pass. This is not as preferable as the arrangement described, however, because the carton is somewhat weakened by employing dust flaps 72 and 86 which would be discontinuous.

Figure 12:
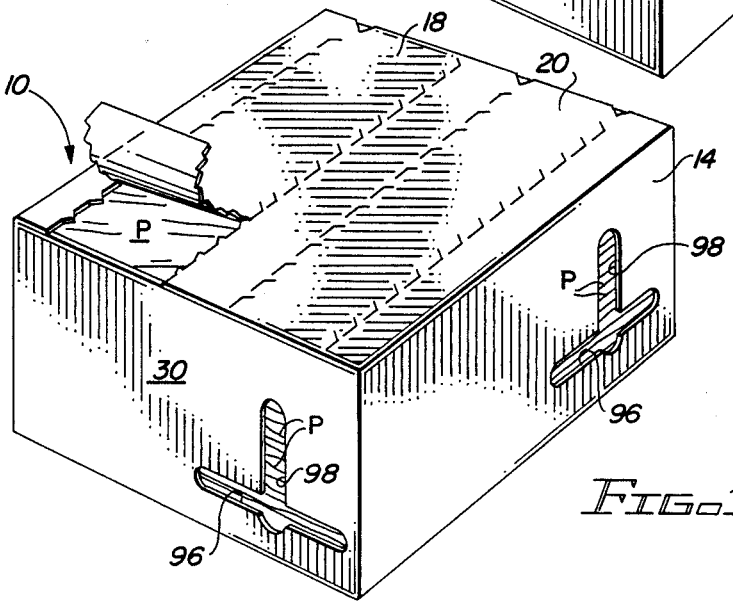
FIG. 12 is a pictorial view similar to that of FIG. 1, but showing a modified carton with a side dispenser feature.

Referring now to FIG. 12, the carton 10 is shown with the tear strip 18 partially removed to illustrate the easy access to the carton interior provided by the carton of the present invention. If desired, horizontal and vertical openings 96 and 98 may be located in each side panel corresponding to the location of the four cells to permit the articles to be removed one at a time. The width of the horizontal opening is large enough to permit a single packet of food to be removed. The vertical opening 98 shows the number of packets remaining in the cell and, by extending below the lower edge of the horizontal opening 96, allows access to the bottom packet in a stack. The dispenser openings 96 and 98 are preferably covered by a removable tab, created, for example, by closely spaced perforations allowing the user to readily punch out the tab from the side panel.

As previously described, the bottom cell divider flaps 24 are comprised of divider flaps 84 and 70 arranged in face-to-face relationship. Although there is no need to glue these flaps together since they are held in place by the bottom panel flaps to which they are adhered, they may be glued together if it is desired to provide cell dividers which present more of an integral appearance to a user who exposes the carton interior through removal of the tear strips.

It will also be appreciated that instead of the bottom divider flaps 84,70, being separated by a gap to permit entry of the divider flap 22, it is possible to achieve the same effect by forming the upper divider flap 22 into two spaced flap sections and the bottom divider flap as a single integral flap. This would allow the same interrelationship of the divider flaps and would not change the carton fabrication procedure.

It will be understood that although the folding and gluing operations which take place in the packaging plant are normally carried out automatically at various stations in a rapidly moving packaging machine, the carton of the invention may be formed and filled manually if desired.

It will now be appreciated that the present invention provides a sturdy, inexpensive carton capable of being formed from a unitary production blank with no need for separate dividers or separators to be inserted in order to create carton cells. It is adaptable to formation in a high speed packaging machine and requires a minimum of paperboard to produce the blank.

It should now be apparent that although a preferred embodiment of the invention has been described, it is contemplated that those skilled in the art may make changes to certain features of the preferred embodiment without altering the overall basic function and concept of the invention and without departing from the spirit and scope of the invention, as defined in the appended claims.

What is claimed is:

1. A multi-celled carton, comprising:

four side panels connected to each other along fold lines, each side panel having an upper edge and a lower edge;

a bottom flap connected along a fold line to the lower edge of each of two opposite side panels, the bottom flaps forming a bottom panel;

cell-dividing flap means connected along a fold line to an edge of at least one of the bottom flaps opposite the fold line connected said one bottom flap to its associated side panel;

the cell-dividing flap means extending into the interior of the carton to divide the interior into two cells;

a top flap connected along a fold line to the upper edge of each of the other two opposite side panels, the top flaps forming a top panel closing the upper end of the carton;

means maintaining the top flaps in closed position; and cell-dividing flap means connected along a fold line to an edge of at least one of the top flaps opposite the fold line connecting said one top flap to its associated side panel;

at least one of the top and bottom cell-dividing flap means including a slot, the other cell-dividing flap means extending through the slot to thereby enable the cell-dividing flap means of said one top flap to extend on either side of the cell dividing flap means of said one bottom flap to divide the interior of the carton into four cells.

2. The carton of claim 1, wherein the cell-dividing flap means of said one bottom flap comprises a plurality of spaced flaps and the cell-dividing flap means of said one top flap comprises a single flap, said single flap extending into the interior of the carton between the spaced flaps of the bottom cell-dividing flap means.

3. A multi-celled carton, comprising:

four side panels connected to each other along fold lines, each side panel having an upper edge and a lower edge;

a bottom panel;

a top flap connected along a fold line to the upper edge of each of two opposite side panels, the top flaps forming an upper panel;

cell-dividing flap means connected along a fold line to an edge of at least one of the top flaps opposite the fold line connecting said one top flap to its associated side panel;

the cell-dividing flap means extending into the interior of the carton to divide the interior into two cells;

the bottom panel comprising a bottom flap connected along a fold line to the lower edge of each of the other two opposite side panels;

cell-dividing flap means connected along a fold line to an edge of at least one of the bottom flaps opposite the fold line connecting said one bottom flap to its associated side panel; and at least one of the upper and lower cell-dividing flap means including a plurality of spaced flaps, the other cell-dividing flap means extending into the interior of the carton through the space between flaps to divide the interior of the carton into four cells.

4. The carton of claim 3, including glue means for adhering the top panel to each of said other two opposite side panels.

5. The carton of claim 4, including dust flaps extending from the lower edges of said two opposite side panels, and glue means adhering the bottom flaps to the dust flaps.

6. A blank for producing a multi-celled carton, comprising:

four side panels sections comprising two end panel sections and two interior panel sections arranged in a row, the interior panel sections being connected to each other and to the end panel sections by fold lines;

bottom panel sections connected by fold lines to one of the end side panel sections and to one of the interior side panel sections which is not adjacent to said one end side panel section;

top panel sections connected by fold lines to the other end side panel sections and to the other interior side panel section;

cell-dividing flap means connected by a fold line to at least one of the top panel sections opposite the fold line connecting said one top panel section to its associated side panel section;

cell-dividing flap means connected by a fold line to at least one of the bottom panel sections opposite the fold line connecting said one bottom flap to its associated side panel section; and at least one of the upper and lower cell-dividing flap means including a plurality of spaced flaps, the other cell-dividing flap means extending into the interior of the carton through the space between flaps to divide the interior of the carton into four cells.

7. The blank of claim 6, including dust flap means connected by fold lines to said other end side panel section and to said other interior side panel section opposite the fold lines connecting the top panel sections to said other end and side panel sections, each dust flap means comprising a plurality of spaced dust flaps adapted to engage and to be adhered to a bottom panel section, the spaced dust flaps being arranged so that the bottom cell-dividing flap means extend into the interior of a carton formed from the blank through the spaces between the dust flaps.

* * * * *